United States Patent [19]

Shah

[11] Patent Number: 4,891,960

[45] Date of Patent: Jan. 9, 1990

[54] YARN FINISH APPLICATOR

[75] Inventor: Chandrakant S. Shah, Seaford, Del.

[73] Assignee: E. I. Du Pont de Nemours and Company, Wilmington, Del.

[21] Appl. No.: 337,132

[22] Filed: Apr. 12, 1989

Related U.S. Application Data

[63] Continuation-in-part of Ser. No. 148,584, Jan. 26, 1988, abandoned.

[51] Int. Cl.[4] ..... D06B 1/08

[52] U.S. Cl. ..... 68/200; 118/420

[58] Field of Search ..... 68/200; 118/420

[56] References Cited

U.S. PATENT DOCUMENTS

| | | | |
|---|---|---|---|
| 2,084,960 | 6/1937 | Johnson et al. . | |
| 2,331,980 | 10/1943 | Hoffman et al. . | |
| 2,373,078 | 4/1945 | Kleist | 118/420 X |
| 3,080,134 | 3/1963 | England et al. . | |
| 3,244,142 | 4/1966 | Walker | 68/200 X |
| 3,401,670 | 9/1968 | Oxford, Jr. | 118/212 |
| 3,468,284 | 9/1969 | Chaban, Jr. | 118/44 |
| 3,988,086 | 10/1976 | Marshall et al. | 425/72.2 |
| 4,051,807 | 10/1977 | Graf et al. | 118/401 |
| 4,156,071 | 5/1979 | Knox | 528/272 |
| 4,253,416 | 3/1981 | Williams, Jr. | 118/401 |
| 4,255,472 | 3/1981 | Williams, Jr. | 118/420 X |
| 4,268,550 | 5/1981 | Williams, Jr. | 118/420 X |
| 4,321,105 | 3/1982 | Melonio et al. | 156/660 |
| 4,325,322 | 4/1982 | Louch et al. | 118/410 |
| 4,329,750 | 5/1982 | Binnersley | 68/200 X |
| 4,397,164 | 8/1983 | Binnersley | 68/200 |
| 4,544,579 | 10/1985 | Mullins et al. | 118/420 X |
| 4,565,154 | 1/1986 | Mullins et al. | 118/420 X |
| 4,605,573 | 8/1986 | Deeg et al. | 118/420 X |
| 4,794,680 | 1/1989 | Meyerhoff et al. | 29/132 |

FOREIGN PATENT DOCUMENTS

| | | | |
|---|---|---|---|
| 0082896 | 7/1983 | European Pat. Off. | 68/200 |
| 2171931 | 9/1986 | United Kingdom | 68/200 |

*Primary Examiner*—Philip R. Coe

[57] ABSTRACT

A yarn finish applicator in which finish is metered to a slot running from top to bottom of the applicator. The configuration of the body of the applicator its slot and the passage supplying liquid to the slot provides a slot configuration that is relatively insensitive to the yarn threadline alignment within the slot.

2 Claims, 3 Drawing Sheets

YARN FINISH APPLICATOR

This application is a continuation-in-part of copending application Ser. No. 07/148,584 filed Jan. 26, 1988, now abandoned.

BACKGROUND OF THE INVENTION

This invention relates to an apparatus for applying liquid finish to a moving continuous filament yarn. More particularly, it relates to an improved groove-type finish applicator that provides uniform finish application to a moving continuous filament yarn with a capability to compensate for yarn misalignment in the slot.

U.S. Pat. No. 4,397,164 of common assignee discloses a yarn finish applicator in which finish is metered to a slot running from top to bottom of the applicator. The configuration of the body of the applicator and its slot provides an edge at the exit end of the applicator and a slot that is slightly wider at the location at which finish is metered to the slot than at exit of the slot.

The yarn finish applicator includes a body member that has top, opposed side, front and back surfaces. A slot with bottom and side walls is formed in the front surface running from top to bottom of the body member. The slot has bottom and side walls with a passage connecting the back surface of the body member through which is metered the desired quantity of liquid finish. The lower portion of the front and back surfaces of the body member are angled downwardly toward each other and in conjunction with the opposed side surfaces which taper downwardly toward each other form an adge at the bottom wall of the slot. The side walls of the slot taper inwardly toward the bottom wall while tapering toward each other from top to bottom. This unique slot configuration not only facilitates placing the moving yarn line in the applicator slot but also prevents the finish from migrating by surface-tension-induced spreading away from the yarn path.

In the apparatus disclosed in the above-noted patent, liquid finish is applied to the yarn through a passage 30 in the bottom wall 28 of the slot 20. When the threadline is aligned in the slot a uniform finish application to the threadline results. However, it has been found that the requirements to adapt these applicators to certain existing equipment are extremely difficult to implement and as a consequence, on occasion, threadline misalignment occurs with respect to the slot in the applicator resulting in less than the desired uniformity of finish application to the threadline passing through the applicator. This is particularly true when the threadline is moving at speeds greater than 3500 meters/minute and applying low finish levels, i.e. about 1%, to the threadline.

SUMMARY OF THE INVENTION

The present invention provides an improvement in the apparatus described in U.S. Pat. No. 4,397,164. In the apparatus of the present invention, the passage supplying liquid to the slot extends through the bottom wall and partially up the side walls of the slot to provide a uniform finish application regardless of threadline alignment within the slot.

DETAILED DESCRIPTION OF THE PREFERRED EMBODIMENT

Figure 1:
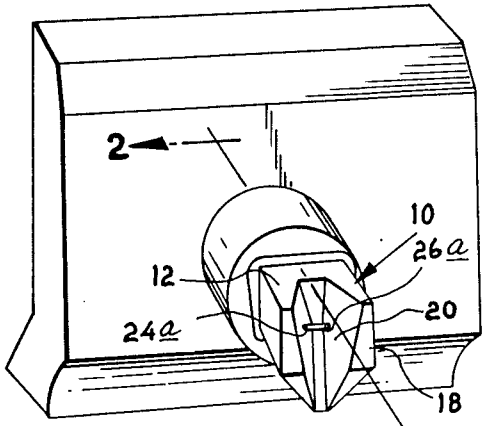
FIG. 1 is a perspective view of the finish applicator of this invention.

Referring to the drawings, the embodiment chosen for purposes of illustration includes an applicator body member 10, a pipe 13, and a bracket 15. The pipe 13 is held in a bore through the upper portion of bracket 15 by means of a set screw 17. The pipe is connected to a source of liquid finish (not shown) by means of fitting 19. The applicator body member 10 which is cemented into the outlet end of pipe 13 has a top surface 12, opposed side surfaces 14, 16 and a front surface 22 which terminates in a lower portion **22*a*. The slot 20 runs from the top surface 12 to the bottom of the applicator body member and is defined by side walls 24, 26 and bottom wall 28. A passage 30 is configured to connect the back surface 22 of the body member with the bottom wall 28 and sidewalls 24, 26 of the slot for supplying a liquid finish to the slot. More particularly, the passage 30 extends through the bottom wall 28 and through a portion 24*a*, 26*a* of each side wall 24, 26, adjacent the bottom wall. Portions 24*a* and 26 a thus become extensions of passage 30. The cross sectional area of each side wall portion of passage 30 generally does not exceed 25 percent and must be at least 15 percent of the cross sectional area of the passage 30 where it extends through the bottom wall. The yarn 11** runs from top to bottom of the applicator as indicated by the arrow.

Figure 2:
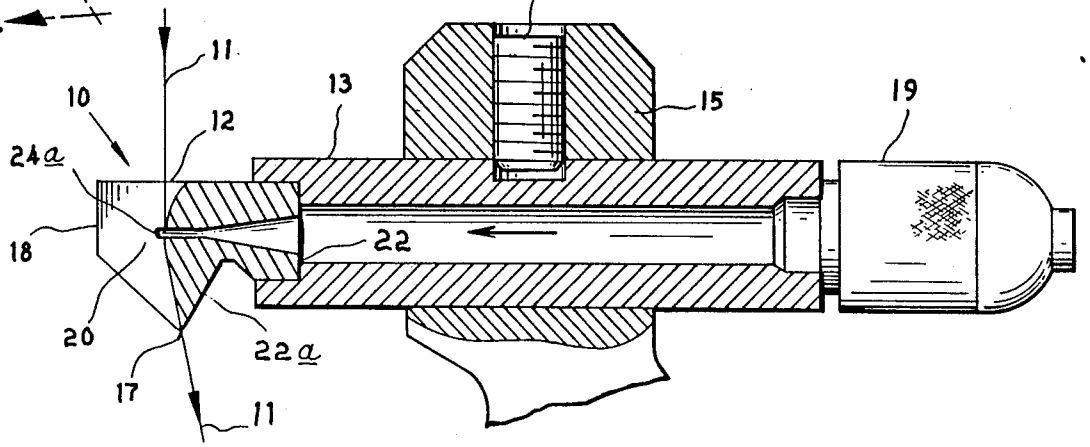
FIG. 2 is a cross-sectional view of FIG. 1 taken along line 2—2.
Figure 3:
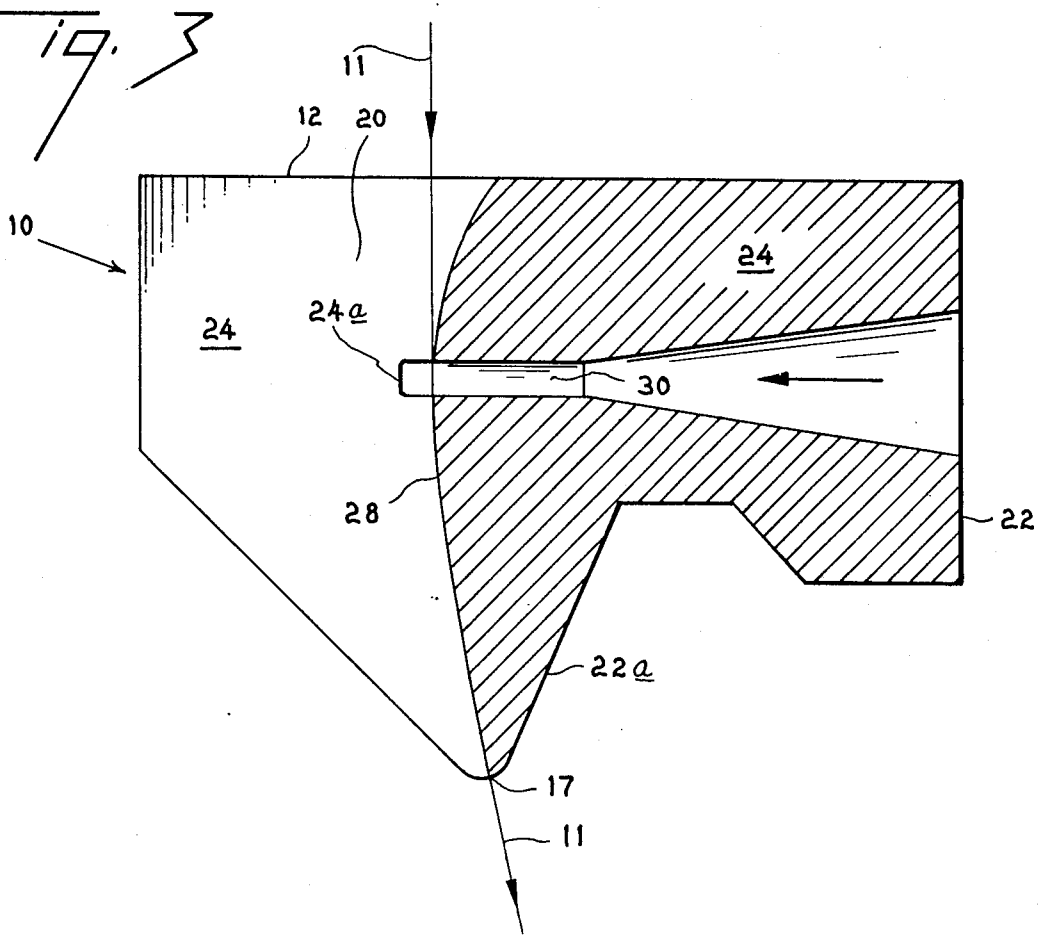
FIG. 3 is an enlarged view of the cross-sectioned applicator body member as seen in FIG. 2.
Figure 4:
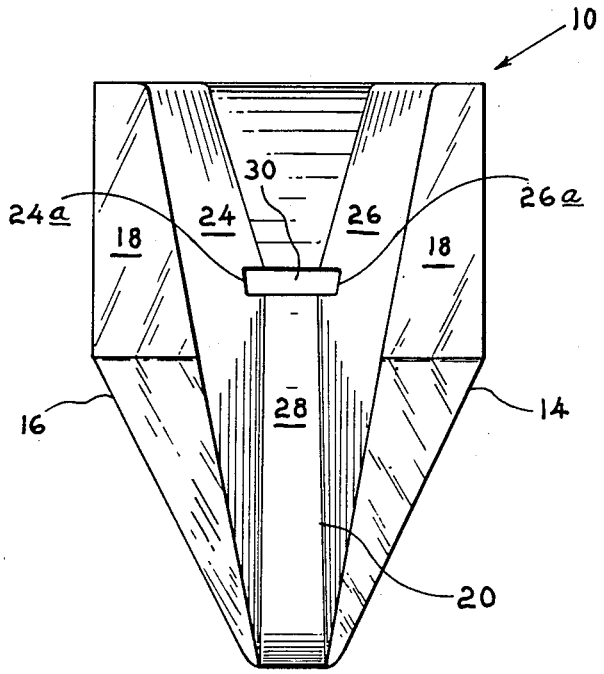
FIG. 4 is an enlarged front view of the applicator body member.

As best seen in FIGS. 2–4 the slot 20 is defined by side walls 24, 26 and a bottom wall 28. The side walls 24, 26 taper inwardly toward each other as they approach bottom wall 28 and also taper toward each other as they progress from top to bottom of the applicator body member. The configuration of the slot 20 is a critical feature of the invention. More particularly, the slot is tapered where the filament bundle of the moving yarn line 11 contacts the bottom wall 28. Finishing liquid is applied to the yarn at the initial point of contact with the bottom and/or side walls of the slot, as the case may be; i.e.; at passage 30.

In operation, the yarn picks up finish at the point of initial yarn contact with the bottom wall or side walls of or both of the slot depending on threadline alignment in the slot at the location where finish is introduced through passage 30 and carries it forward along the tapered slot 20 and exits the slot tangentially with the bottom surface 28 with no separation between the bottom surface 28 and the threadline. The combination of the fully wiped bottom surface and the tangential exit of the yarn from the slot permits all of the finish to leave the slot wit the yarn giving a uniform finish application on the yarn without the formation of drops at the exit end of the applicator.

The applicator of this invention may be used to apply liquid materials which are not harmful to the yarn or the applicating system. Examples of liquids which may be applied are solutions, dyes, dispersions, or emulsions of conventional treating agents such as lubricants, antistatic agents, binders, softeners and the like. The liquid may be applied to such man-made continuous filament yarns as, for example, polyamides, polyesters, polyacrylics, spandex, rayon, and cellulose acetate.

In a series of test runs with extensions 24a and 26a having varying cross sectional areas as a percentage of the cross sectional area of passage 30, all other conditions being essentially the same, it was observed (Table I) that finish application was more uniform, evidenced by dye spread along-end and end-to-end of the yarn when the cross sectional areas of each of the extensions 24a and 26a were at least 15 percent of the cross sectional area of passage 30 where it extends through the bottom wall of the slot.

TABLE I

| Extensions | Dye Spread | | Average % Finish on Yarn |
|---|---|---|---|
| | Along-End | End-to-End | |
| None | 5.5 | 7.5 | .7 |
| 5% of slot area | 6.0 | 7.5 | .75 |
| 10% of slot area | 5.5 | 7.0 | .8 |
| 15% of slot area | 2.5 | 3.5 | .8 |

I claim:

1. In a yarn finish applicator that includes a body member having top, opposed side and front and back surfaces and a slot in the front surface running from top to bottom, said slot having bottom and side walls, and a passage connecting the back surface of the body member to the slot for supplying finish to said slot, the improvement comprising: said passage connecting said back surface of the body member to said slot by extending through the bottom wall of the slot and through a portion of each side wall adjacent said bottom wall, providing extensions to said passage, said extensions having a cross sectional area of at least 15 percent of the cross sectional area of the passage where it extends through said bottom wall.

2. The applicator as defined in claim 1, the cross sectional of said extensions being in the range of from about 15 percent to about 25 percent of the cross sectional area of the passage where it extends through the bottom wall.

* * * * *